US010655465B2

(12) United States Patent
Lu et al.

(10) Patent No.: US 10,655,465 B2
(45) Date of Patent: May 19, 2020

(54) METHOD FOR ROCK BURST PREVENTION BY ACTIVE SUPPORT REINFORCEMENT AND ACTIVE PRESSURE RELIEF

(71) Applicants: China University of Mining and Technology, Xuzhou, Jiangsu (CN); XUZHOU JINBO SAFETY AND TECHNOLOGY CO., LTD, Xuzhou, Jiangsu (CN)

(72) Inventors: Caiping Lu, Jiangsu (CN); Heng Zhang, Jiangsu (CN); Yang Liu, Jiangsu (CN); Ding Li, Jiangsu (CN)

(73) Assignees: China University of Mining and Technology, Xuzhou, Jiangsu (CN); XUZHOU JINBO SAFETY AND TECHNOLOGY CO., LTD., Xuzhou, Jiangsu (CN)

( * ) Notice: Subject to any disclaimer, the term of this patent is extended or adjusted under 35 U.S.C. 154(b) by 0 days.

(21) Appl. No.: 16/334,761

(22) PCT Filed: Aug. 3, 2018

(86) PCT No.: PCT/CN2018/098544
§ 371 (c)(1),
(2) Date: Mar. 20, 2019

(87) PCT Pub. No.: WO2019/148788
PCT Pub. Date: Aug. 8, 2019

(65) Prior Publication Data

US 2020/0032647 A1 Jan. 30, 2020

(30) Foreign Application Priority Data

Jan. 31, 2018 (CN) ..... 2018 1 0094549

(51) Int. Cl.
*E21B 49/00* (2006.01)
*E21D 20/02* (2006.01)
(Continued)

(52) U.S. Cl.
CPC ..... *E21B 49/005* (2013.01); *E21D 20/02* (2013.01); *E21F 17/185* (2013.01); *E21D 20/003* (2013.01)

(58) Field of Classification Search
CPC ..... E21B 49/005; E21D 20/02; E21F 17/185
See application file for complete search history.

(56) References Cited

U.S. PATENT DOCUMENTS 5,782,539 A 7/1998 Peterson

FOREIGN PATENT DOCUMENTS

CN 102041306 A 5/2011
CN 102425416 A 4/2012
(Continued)

*Primary Examiner* — Tara Mayo-Pinnock
(74) *Attorney, Agent, or Firm* — Winston Hsu

(57) ABSTRACT

Disclosed is a method for rock burst prevention by active support reinforcement and active pressure relief. The method comprises the following steps: A. rating a burst tendency based on a comprehensive index method: determining a zone as a general risk region or a mediate risk region by using a comprehensive index method; B. predicting a burst risk region and determining pressure relief borehole parameters in real time by using a drill cuttings method: determining borehole parameters of the general risk region and the mediate risk region; C. drilling holes after determining arrangement patterns of large-diameter pressure relief boreholes according to different burst risk levels; D. forming a "coal wall-bolt-grouting hole sealing" support reinforcement system through a roadway support system; and E. monitoring a pressure relief effect of the support reinforcement system: until a required effect of preventing bursts by pressure relief is achieved while the support is
(Continued)

reinforced. The present invention can not only achieve an effect of preventing rock bursts by pressure relief but also enhance the integrity of a coal wall in a roadway excavation process, thereby achieving the objective of rock burst prevention by active support reinforcement and active pressure relief.

1 Claim, 2 Drawing Sheets

(51) Int. Cl.
*E21F 17/18* (2006.01)
*E21D 20/00* (2006.01)

(56) References Cited

FOREIGN PATENT DOCUMENTS

| | | | |
|---|---|---|---|
| CN | 103244179 | A | 8/2013 |
| CN | 103362551 | A | 10/2013 |
| CN | 104832198 | A | 8/2015 |
| CN | 107013216 | A | 8/2017 |

METHOD FOR ROCK BURST PREVENTION BY ACTIVE SUPPORT REINFORCEMENT AND ACTIVE PRESSURE RELIEF

BACKGROUND OF THE INVENTION

1. Field of the Invention

The present invention relates to a method for rock burst prevention, and specifically, to a method for rock burst prevention by active support reinforcement and active pressure relief.

2. Description of the Prior Art

In recent years, as the coal-mining depth increases gradually, the rock burst phenomenon is receiving more attention all over the world. In order to reduce rock bursts effectively, common treatment methods at present include pressure relief with large-diameter boreholes, coal pressure-relief blasting, roof pressure-relief blasting, pressure relief by coal seam water infusion, and other burst prevention measures. Pressure relief with large-diameter boreholes is a method for rock burst prevention by active pressure relief. According to the principle of "three-dimensional stress transfer", a large-diameter borehole causes structural damage to surrounding rock in a deep part of a roadway (i.e., surrounding rock near a distal end of the borehole), and a weakened zone is thus formed, which causes high stress in surrounding rock in a peripheral area of the roadway to transfer to the deep part. As a result, the surrounding rock in the peripheral area of the roadway is located in a low stress region. When a burst occurs, on one hand, the space of the large-diameter borehole can absorb burst pulverized coal and prevent the coal from bursting out; on the other hand, the closure of the roof and floor in a pressure relief region produces a "wedge-shaped" resistance zone, which can also prevent disasters caused by coal bursts. However, it is found in engineering practice that although pressure relief with large-diameter boreholes can achieve a good pressure relief effect, the presence of the large-diameter boreholes affects the integrity of a coal wall and destroys the self-supporting capability of the coal, thus increasing the support difficulty and severely affecting safe production in coal mines.

SUMMARY OF THE INVENTION

In view of the above problems in the prior art, the present invention provides a method for rock burst prevention by active support reinforcement and active pressure relief, which cannot only achieve an effect of preventing rock bursts by pressure relief but also enhance the integrity of a coal wall in a roadway excavation process, thereby achieving the objective of rock burst prevention by active support reinforcement and active pressure relief.

In order to achieve the foregoing objective, the present invention adopts the following technical solution: a method for rock burst prevention by active support reinforcement and active pressure relief, which specifically includes the following steps:

A. Rating a Burst Tendency Based on a Comprehensive Index Method:

Rating is performed by using a comprehensive index method according to degrees of influence on a rock burst from geological factors around a mining face in danger of bursts and mining technique factors, as well as a rock burst risk status; if a burst risk index of a region is less than 0.25, the region is defined as a risk-free region, and stoping is performed normally in this case; if the burst risk index is 0.25 to 0.5, the region is defined as a general risk region, and pressure needs to be relieved with large-diameter boreholes; if the burst risk index is 0.5 to 0.75, the region is defined as a mediate risk region, and the density of large-diameter boreholes for pressure relief needs to be increased; if the burst risk index is greater than 0.75, the region is defined as a high burst risk region, and stoping is stopped in this case;

B. Predicting and monitoring a burst risk level of a burst risk region and determining pressure relief borehole parameters by using a drill cuttings method:

20 holes with a diameter of 42 mm, a depth of 6 to 8 m and a pitch of 3 to 5 m are drilled in a normal-pressure coal seam on the external side of the working face, the boreholes being parallel to an inclination direction of the coal seam and having a height of 1.0 to 1.2 m to the floor; the amount of pulverized coal per meter of each hole is recorded; then a weighted average of the recorded amounts is calculated as a standard amount of pulverized coal (normal value), a curve of the standard amount of pulverized coal is drawn, and a peak value of the amount of pulverized coal is marked; next, boreholes are drilled at intervals of 3 to 5 m from a coal wall of the working face towards two sides of the external roadway, and the amount of pulverized coal per meter of each hole is recorded; then the recorded amount is compared with the standard amount of pulverized coal to calculate a difference; if the difference is greater than twice the normal value, it indicates that the region already has a burst risk, and proactive pressure relief needs to be performed;

If the burst risk region is rated as a general risk region in step A, the pressure relief borehole parameters are as follows: the borehole depth is not less than 10 m, the borehole diameter is not less than 110 mm, and the hole pitch is 4 m; and If the burst risk region is rated as a mediate risk region in step A, the pressure relief borehole parameters are as follows: the borehole depth is not less than 15 m, the borehole diameter is not less than 110 mm, and the hole pitch is 3 m;

C. Drilling Holes after Determining Arrangement Patterns of Large-Diameter Pressure Relief Boreholes According to Different Burst Risk Levels:

If the burst risk region is a general risk region, the arrangement pattern of pressure relief boreholes is as follows: in an area covering above 50 m behind the excavation heading or in the burst risk region, large-diameter boreholes with a hole diameter greater than 110 mm and a hole depth of 10 m are drilled at intervals of 2 to 3 m, the boreholes being perpendicular to the integrated coal and arranged in a single row along the center line of the roadway; two large-diameter boreholes with a hole depth of 10 m are arranged at the heading; and If the burst risk region is a mediate risk region, the arrangement pattern of pressure relief boreholes is as follows: in an area covering above 50 m behind the excavation heading or in the burst risk region, large-diameter boreholes with a hole diameter greater than 110 mm and a hole depth of 20 m are drilled at intervals of 1.5 m, the boreholes being perpendicular to the coal rib and arranged in a staggered pattern, with a distance of 0.8 to 1.5 m to the floor; two large-diameter boreholes with a hole depth of 20 m are arranged at the heading;

D. Forming a "Coal Wall-Bolt-Grouting Hole Sealing" Support Reinforcement System Through a Roadway Support System:

Hollow grouting bolts are installed in the large-diameter pressure relief boreholes on two sides of the roadway, a bolt length being slightly greater than a hole sealing length; then grouting hole sealing reinforcement is performed, the hole sealing length being set to 10 m or 5 m; because the integrity of the coal wall is maintained after grouting reinforcement while the coal wall near the boreholes is hardened due to the effect of grout, a "coal wall-bolt-grouting hole sealing" support reinforcement system is formed; and E. Monitoring a Pressure Relief Effect of the Support Reinforcement System:

Rock bursts are monitored through multiple drill cuttings measuring points arranged in step B; if the pressure relief effect of the support reinforcement system does not achieve an effect of lowering the level of the burst risk region, step C is performed again to further increase the drilling density, thus ensuring the pressure relief effect of the pressure relief boreholes; after the interior of each pressure relief borehole is adequately broken up, the drill cuttings method in step B is further performed at the intact coal wall near the pressure relief borehole to monitor rock bursts; if the effect of lowering the level of the burst risk region is still not achieved, steps C and D are repeated to drill holes and perform the grouting hole sealing method again, until the required effect of preventing bursts by pressure relief is achieved while the performance of support reinforcement is achieved.

Compared with the prior art, the present invention combines the rock burst prevention by active pressure relief with an active support system. Grouting bolts are installed in the large-diameter pressure relief boreholes for grouting hole sealing, so that the stability of two sides of the roadway is improved. Meanwhile, the large-diameter pressure relief boreholes are retained, so that the effect of pressure relief by boreholes can still be achieved. Therefore, the present invention not only can achieve the effect of rock burst prevention by active pressure relief but also can realize the active support function, thus guaranteeing safe production in coal mines.

These and other objectives of the present invention will no doubt become obvious to those of ordinary skill in the art after reading the following detailed description of the preferred embodiment that is illustrated in the various figures and drawings.

DETAILED DESCRIPTION

The present invention is further described below.

Figure 1:
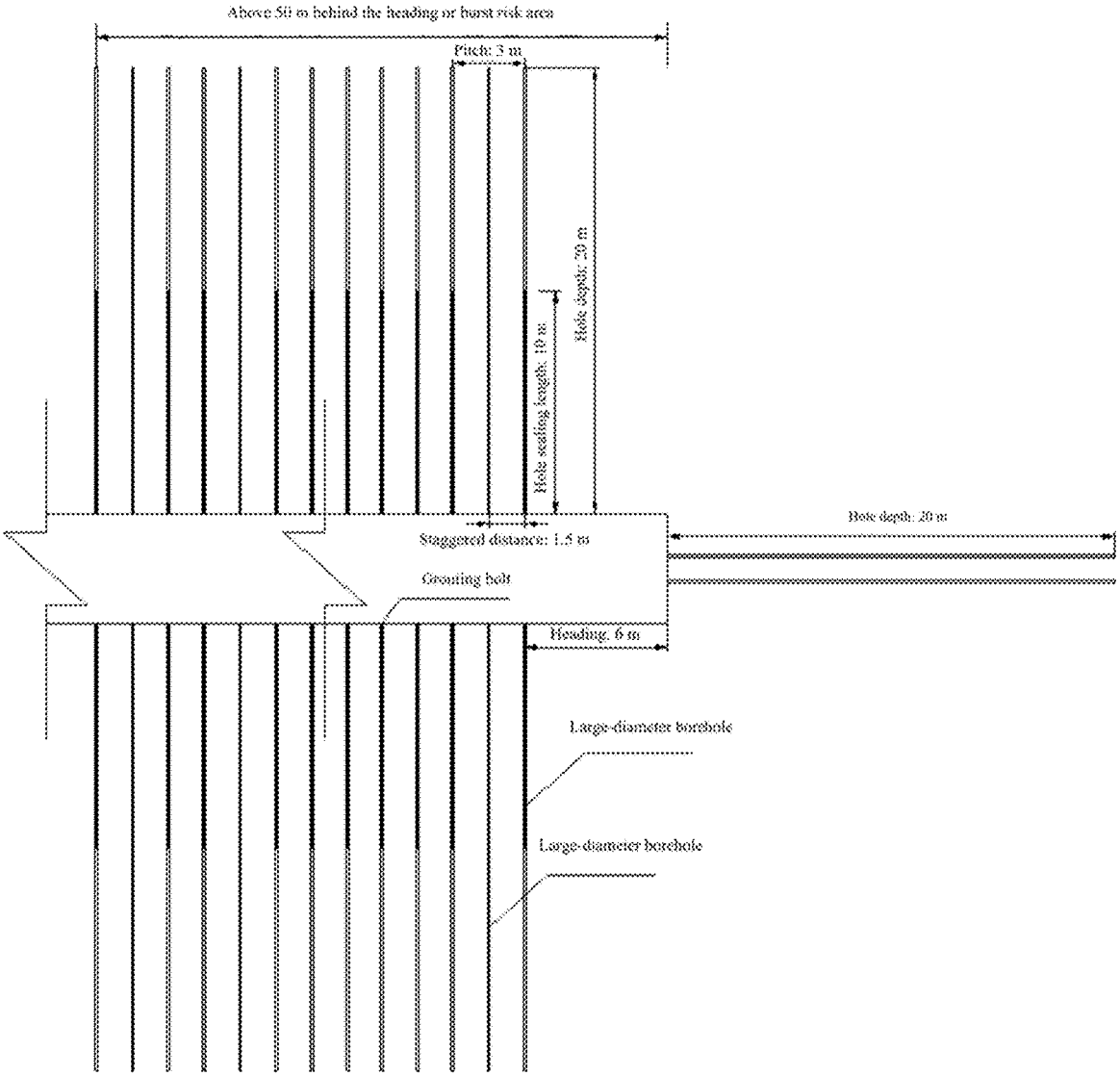
FIG. 1 is a schematic diagram of a plane layout along a roadway excavation direction according to the present invention.
Figure 2:
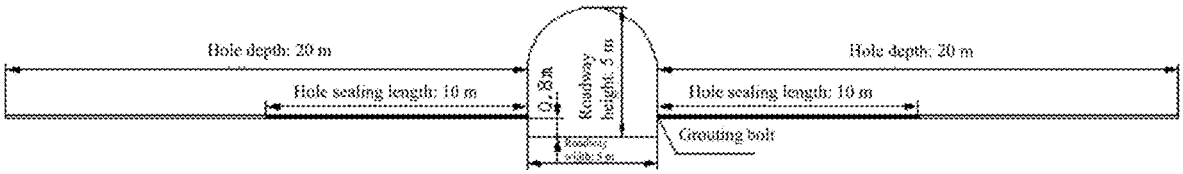
FIG. 2 is a schematic diagram of a cross-sectional layout along a roadway excavation direction according to the present invention.
Figure 3:
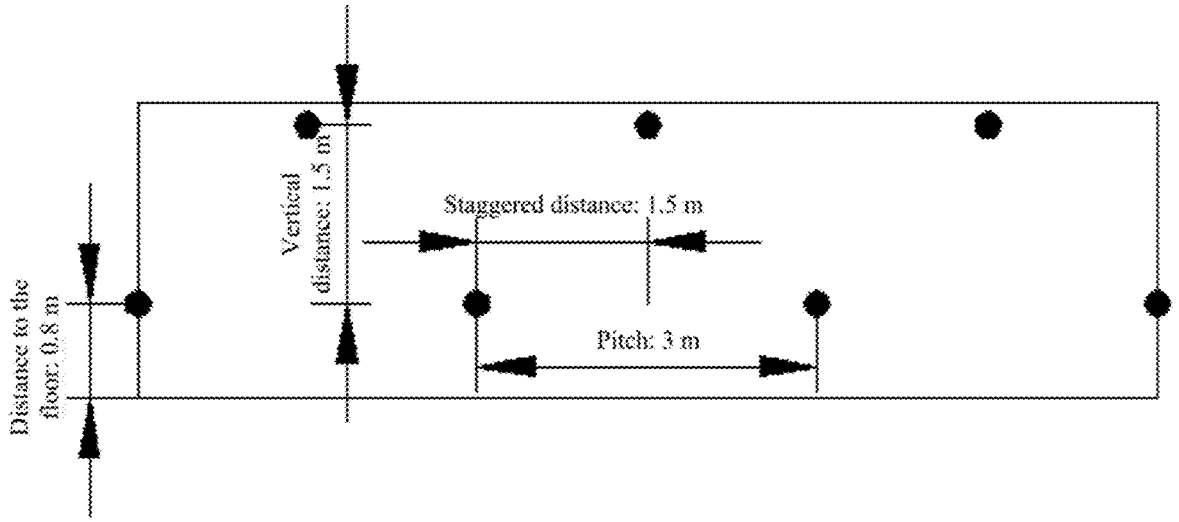
FIG. 3 is a schematic diagram of a layout pattern of large-diameter pressure relief boreholes according to the present invention.
Figure 4:
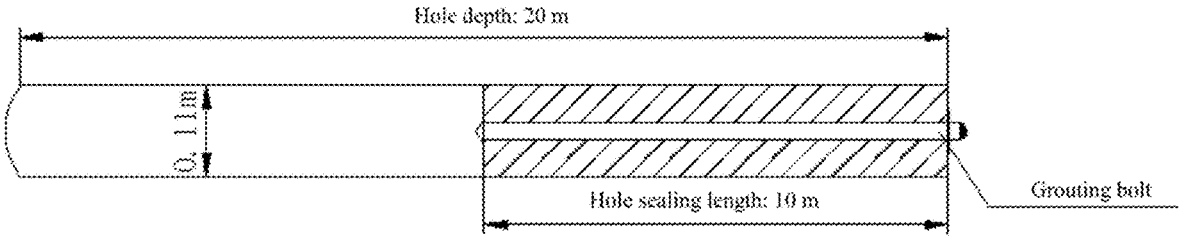
FIG. 4 is a schematic diagram of hole sealing grouting with a grouting bolt according to the present invention.

As shown in FIG. 1 to FIG. 4, the present invention specifically includes the following steps:

A. Rate a Burst Tendency Based on a Comprehensive Index Method:

Rating is performed by using a comprehensive index method according to a rock burst risk status as well as degrees of influence on a rock burst from geological factors around a mining face in danger of bursts and mining technique factors; if a burst risk index of a region is less than 0.25, the region is defined as a risk-free region, and stoping is performed normally in this case; if the burst risk index is 0.25 to 0.5, the region is defined as a general risk region, and pressure needs to be relieved with large-diameter boreholes; if the burst risk index is 0.5 to 0.75, the region is defined as a mediate risk region, and the density of large-diameter boreholes for pressure relief needs to be increased; if the burst risk index is greater than 0.75, the region is defined as a high burst risk region, and stoping is stopped in this case.

B. Predicting and monitoring a burst risk level of a burst risk region and determining pressure relief borehole parameters by using a drill cuttings method:

20 holes with a diameter of 42 mm, a depth of 6 to 8 m and a pitch of 3 to 5 m are drilled in a normal-pressure coal seam on the external side of the working face, where the boreholes are parallel to an inclination direction of the coal seam and have a height of 1.0 to 1.2 m to the floor; the amount of pulverized coal per meter of each hole is recorded; then a weighted average of the recorded amounts is calculated as a standard amount of pulverized coal (normal value), a curve of the standard amount of pulverized coal is drawn, and a peak value of the amount of pulverized coal is marked; next, boreholes are drilled at intervals of 3 to 5 m from a coal wall of the working face towards two sides of the external roadway, and the amount of pulverized coal per meter of each hole is recorded; then the recorded amount is compared with the standard amount of pulverized coal to calculate a difference; if the difference is greater than twice the normal value, it indicates that the region already has a burst risk, and proactive pressure relief needs to be performed.

20 holes with a diameter of 42 mm, a depth of 6 to 8 m and a pitch of 3 to 5 m are drilled in a normal-pressure coal seam on the external side of the working face, where the boreholes are parallel to an inclination direction of the coal seam and have a height of 1.0 to 1.2 m to the floor; the amount of pulverized coal per meter of each hole is recorded; then a weighted average of the recorded amounts is calculated as a standard amount of pulverized coal (normal value), a curve of the standard amount of pulverized coal is drawn, and a peak value of the amount of pulverized coal is marked; next, boreholes are drilled at intervals of 3 to 5 m from a coal wall of the working face towards two sides of the external roadway, and the amount of pulverized coal per meter of each hole is recorded; then the recorded amount is compared with the standard amount of pulverized coal to calculate a difference; if the difference is greater than twice the normal value, it indicates that the region already has a burst risk, and proactive pressure relief needs to be performed.

If the burst risk region is rated as a general risk region in step A, the pressure relief borehole parameters are as follows: the borehole depth is not less than 10 m, the borehole diameter is not less than 110 mm, and the hole pitch is 4 m.

If the burst risk region is rated as a mediate risk region in step A, the pressure relief borehole parameters are as follows: the borehole depth is not less than 15 m, the borehole diameter is not less than 110 mm, and the hole pitch is 3 m.

C. Drill Holes after Determining Arrangement Patterns of Large-Diameter Pressure Relief Boreholes According to Different Burst Risk Levels:

If the burst risk region is a general risk region, the arrangement pattern of pressure relief boreholes is as follows: in an area covering above 50 m behind the excavation heading or in the burst risk region, large-diameter boreholes with a hole diameter greater than 110 mm and a hole depth of 10 m are drilled at intervals of 2 to 3 m, where the boreholes are perpendicular to the coal rib and arranged in a single row along the center line of the roadway; two large-diameter boreholes with a hole depth of 10 m are arranged at the heading.

If the burst risk region is a mediate risk region, the arrangement pattern of pressure relief boreholes is as follows: in an area covering above 50 m behind the excavation heading or in the burst risk region, large-diameter boreholes with a hole diameter greater than 110 mm and a hole depth of 20 m are drilled at intervals of 1.5 m, where the boreholes are perpendicular to the integrated coal and arranged in a staggered pattern, with a distance of 0.8 to 1.5 m to the floor; two large-diameter boreholes with a hole depth of 20 m are arranged at the heading;

D. Form a "Coal Wall-Bolt-Grouting Hole Sealing" Support Reinforcement System Through a Roadway Support System:

Hollow grouting bolts are installed in the large-diameter pressure relief boreholes on two sides of the roadway, a bolt length being slightly greater than a hole sealing length; then grouting hole sealing reinforcement is performed, the hole sealing length being set to 10 m or 5 m; because the integrity of the coal wall is maintained after grouting reinforcement while the coal wall near the boreholes is hardened due to the effect of grout, a "coal wall-bolt-grouting hole sealing" support reinforcement system is formed; and E. Monitor a Pressure Relief Effect of the Support Reinforcement System:

Rock bursts are monitored through multiple drill cuttings measuring points arranged in step B; if the pressure relief effect of the support reinforcement system does not achieve an effect of lowering the level of the burst risk region, step C is performed again to further increase the drilling density, thus ensuring the pressure relief effect of the pressure relief boreholes; after the interior of each pressure relief borehole is adequately broken up, the drill cuttings method in step B is further performed at the intact coal wall near the pressure relief borehole to monitor rock bursts; if the effect of lowering the level of the burst risk region is still not achieved, steps C and D are repeated to drill holes and perform the grouting hole sealing method again, until the required effect of preventing bursts by pressure relief is achieved while the performance of support reinforcement is achieved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for rock burst prevention by active support reinforcement and active pressure relief, specifically comprising the following steps:

A) Rating a burst tendency based on a comprehensive index method:

rating is performed by using a comprehensive index method according to a rock burst risk status as well as degrees of influence on a rock burst from geological factors around a mining face in danger of bursts and mining technique factors; if a burst risk index of a region is less than 0.25, it is defined as a risk-free region, and stoping is performed normally in this case without the need for pressure relief; if the burst risk index is 0.25 to 0.5, the region is defined as a general risk region; if the burst risk index is 0.5 to 0.75, the region is defined as a mediate risk region; if the burst risk index is greater than 0.75, the region is defined as a high burst risk region, and stoping is stopped in this case;

B) Predicting and monitoring a burst risk level of a burst risk region and determining pressure relief borehole parameters by using a drill cuttings method:

20 holes with a diameter of 42 mm, a depth of 6 to 8 m and a pitch of 3 to 5 m are drilled in a normal-pressure coal seam on the external side of the working face, the boreholes being parallel to an inclination direction of the coal seam and having a height of 1.0 to 1.2 m to the floor; the amount of pulverized coal per meter of each hole is recorded; then a weighted average of the recorded amounts is calculated as a standard amount of pulverized coal, a curve of the standard amount of pulverized coal is drawn, and a peak value of the amount of pulverized coal is marked; next, boreholes are drilled at intervals of 3 to 5 m from a coal wall of the working face towards two sides of the external roadway, and the amount of pulverized coal per meter of each hole is recorded; then the recorded amount is compared with the standard amount of pulverized coal to calculate a difference; if the difference is greater than twice a normal value, it indicates that the region already has a burst risk;

if the burst risk region is rated as the general risk region in step A), the pressure relief borehole parameters are as follows: the borehole depth is not less than 10 m, the borehole diameter is not less than 110 mm, and the hole pitch is 4 m; and if the burst risk region is rated as the mediate risk region in step A), the pressure relief borehole parameters are as follows: the borehole depth is not less than 15 m, the borehole diameter is not less than 110 mm, and the hole pitch is 3 m;

C) Drilling holes after determining arrangement patterns of large-diameter pressure relief boreholes according to different burst risk levels:

if the burst risk region is the general risk region, the arrangement pattern of pressure relief boreholes is as follows: in an area covering above 50 m behind the excavation heading or in the burst risk region, large-diameter boreholes with a hole diameter greater than 110 mm and a hole depth of 10 m are drilled at intervals of 2 to 3 m, the boreholes being perpendicular to the integrated coal and arranged in a single row along the center line of the roadway; two large-diameter boreholes with a hole depth of 10 m are arranged at the heading; and if the burst risk region is the mediate risk region, the arrangement pattern of pressure relief boreholes is as follows: in an area covering above 50 m behind the excavation heading or in the burst risk region, large-diameter boreholes with a hole diameter greater than 110 mm and a hole depth of 20 m are drilled at intervals of 1.5 m, the boreholes being perpendicular to the integrated coal and arranged in a staggered pattern, with a distance of 0.8 to 1.5 m to the floor; two large-diameter boreholes with a hole depth of 20 m are arranged at the heading;

D) Forming a coal wall-bolt-grouting hole sealing support reinforcement system through a roadway support system:

Hollow grouting bolts are installed in the large-diameter pressure relief boreholes on two sides of the roadway, a bolt length being slightly greater than a hole sealing length; then grouting hole sealing reinforcement is performed, the hole sealing length being set to 10 m or 5 m; because the integrity of the coal wall is maintained after grouting reinforcement while the coal wall near the boreholes is hardened due to the effect of grout, the coal wall-bolt-grouting hole sealing support reinforcement system is formed; and E) Monitoring a pressure relief effect of the support reinforcement system:

rock bursts are monitored through multiple drill cuttings measuring points arranged in step B); if the pressure relief effect of the support reinforcement system does not achieve an effect of lowering the level of the burst risk region, step C) is performed again to further increase the drilling density, thus ensuring the pressure relief effect of the pressure relief boreholes; after the interior of each pressure relief borehole is adequately broken up, the drill cuttings method in step B) is further performed at the intact coal wall near the pressure relief borehole to monitor rock bursts; if the effect of lowering the level of the burst risk region is still not achieved, steps C) and D) are repeated to drill holes and perform the grouting hole sealing method again, until the required effect of preventing bursts by pressure relief is achieved while the performance of support reinforcement is achieved.

* * * * *